US012383024B2

(12) United States Patent
Hillyer et al.

(10) Patent No.: US 12,383,024 B2
(45) **Date of Patent: *Aug. 12, 2025**

(54) FOOTWEAR INCLUDING A STABILIZING SOLE

(71) Applicant: DECKERS OUTDOOR CORPORATION, Goleta, CA (US)

(72) Inventors: Christopher Hillyer, Goleta, CA (US); Zack Paris, Goleta, CA (US); Kyle Pulli, La Jolla, CA (US)

(73) Assignee: DECKERS OUTDOOR CORPORATION, Goleta, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/444,916

(22) Filed: Feb. 19, 2024

(65) Prior Publication Data

US 2024/0188679 A1 Jun. 13, 2024

Related U.S. Application Data

(63) Continuation of application No. 17/662,358, filed on May 6, 2022, now Pat. No. 11,937,665, which is a continuation of application No. 16/793,916, filed on Feb. 18, 2020, now Pat. No. 11,344,080, which is a continuation-in-part of application No. 15/350,747, filed on Nov. 14, 2016, now Pat. No. 10,561,199.

(51) Int. Cl.
*A43B 13/18* (2006.01)

(52) U.S. Cl.
CPC ..... *A43B 13/18* (2013.01)

(58) Field of Classification Search
CPC . A43B 13/181; A43B 13/1481; A43B 13/184; A43B 5/06
USPC ..... 36/31
See application file for complete search history.

(56) References Cited

U.S. PATENT DOCUMENTS

| | | | | |
|---|---|---|---|---|
| 7,200,955 | B2 | 4/2007 | Foxen | |
| 7,797,856 | B2 * | 9/2010 | Andrews | A43B 13/12 36/25 R |
| 8,272,149 | B2 | 9/2012 | Cooper et al. | |
| 8,595,956 | B2 | 12/2013 | Byrne | |
| 9,167,867 | B2 * | 10/2015 | Fahmi | A43B 7/1405 |
| 10,561,199 | B2 | 2/2020 | Hillyer et al. | |
| 11,344,080 | B2 * | 5/2022 | Hillyer | A43B 13/223 |
| 11,490,683 | B2 | 11/2022 | Hillyer et al. | |
| 11,937,665 | B2 * | 3/2024 | Hillyer | A43B 13/18 |
| 2003/0192202 | A1 * | 10/2003 | Schoenborn | A43B 13/16 36/31 |
| 2005/0268490 | A1 | 12/2005 | Foxen | |
| 2005/0268492 | A1 | 12/2005 | Fuerst | |
| 2007/0277401 | A1 | 12/2007 | Young-Chul | |

(Continued)

*Primary Examiner* — Timothy K Trieu
(74) *Attorney, Agent, or Firm* — Greer, Burns & Crain, Ltd

(57) ABSTRACT

A sole for an article of footwear is provided and includes a midsole attached to the upper and including a lateral side and a medial side, the midsole including a first member and a second member attached to the first member, the first member being separate from the second member, the first member having a sidewall and a recessed area and the second member having a sidewall that extends along the medial side around the heel portion and along the lateral side of the first member, the second member being positioned in the recessed area of the first member.

9 Claims, 12 Drawing Sheets

(56) References Cited

U.S. PATENT DOCUMENTS

| | | | | |
|---|---|---|---|---|
| 2008/0216360 | A1* | 9/2008 | Schenone | A43B 13/14 36/30 R |
| 2008/0250673 | A1* | 10/2008 | Andrews | A43B 13/188 36/25 R |
| 2011/0185590 | A1 | 8/2011 | Nishiwaki et al. | |
| 2011/0192056 | A1* | 8/2011 | Geser | A43B 13/26 36/114 |
| 2012/0317845 | A1 | 12/2012 | Vattes | |
| 2013/0081305 | A1 | 4/2013 | Byrne | |
| 2014/0123522 | A1 | 5/2014 | Rustam et al. | |
| 2014/0259784 | A1 | 9/2014 | Jenkins et al. | |
| 2014/0325876 | A1 | 11/2014 | Dodge et al. | |
| 2014/0373392 | A1 | 12/2014 | Cullen | |
| 2015/0181976 | A1 | 7/2015 | Cooper et al. | |
| 2018/0132563 | A1 | 5/2018 | Hillyer et al. | |
| 2020/0178644 | A1 | 6/2020 | Hillyer et al. | |
| 2020/0178646 | A1 | 6/2020 | Hillyer et al. | |
| 2022/0256970 | A1 | 8/2022 | Hillyer et al. | |

* cited by examiner

FOOTWEAR INCLUDING A STABILIZING SOLE

CROSS REFERENCE TO RELATED APPLICATIONS

This application is a continuation application of and claims priority to U.S. patent application Ser. No. 17/662,358 filed on May 6, 2022, which is a continuation application of and claims priority to U.S. patent application Ser. No. 16/793,916 filed on Feb. 18, 2020, now U.S. Pat. No. 11,344,080, which is a continuation-in-part application of and claims priority to U.S. patent application Ser. No. 15/350,747 filed on Nov. 14, 2016, now U.S. Pat. No. 10,561,199, which are all incorporated herein by reference.

BACKGROUND

The present application relates generally to footwear, and more particularly, to a stabilizing sole for footwear that uniformly supports a wearer's feet to help absorb the stress and shock on a person's body generated during repeated impact between their feet and the ground during impact movements such as walking, jogging and running.

Running is particularly hard on a person's feet and body. For example, the impact of each foot striking the ground during running is the equivalent of three to five times of your body weight or more. Insufficient cushioning and support and/or misalignment of a person's feet within their shoes reduces the absorption of this impact, thereby transferring more of the shock and stress to the user's body, and unnecessarily stressing the knees, hips and lower back. As a person runs, the shock and stress are repeated at every impact or foot strike with the ground, which can cause stress injuries, pain and excess wear on the person's joints.

When the feet and ankles are properly supported and aligned, a person's body is able to absorb large impact forces. Also, overall stability and biomechanical efficiency improves to help the feet absorb and reduce impact forces, while forming an efficient lever to channel power correctly during propulsion. Footwear manufacturers utilize these concepts when developing and improving footwear alignment and support structures for shoes.

There are many different types of support structures for footwear to help absorb the shock and stresses on a user's feet. These structures typically revolve around the midsoles and outsoles but may also include the uppers. Some of the structures involve changing the thicknesses of the midsole and/or outsole to provide more cushioning and support to different parts of a user's foot. For example, the combined thickness of the midsole and outsole may be greater at a certain portion of a user's foot, such as the heel, to provide more support for the heel during walking, jogging or running. Alternatively, the combined thickness of the midsole and outsole may be greater at the medial or lateral sides of a shoe to help compensate for the roll of a person's foot during running such as over pronation or under pronation, i.e., supination.

Other support structures utilize different materials to form the midsole and outsole, where the materials have different hardness levels. For example, the hardness of the material used to form the midsole may be greater than the hardness of the outsole such that the outsole absorbs most of the impact and the harder midsole provides support for the feet. Similarly, the hardness of the materials may be different at different portions of the foot to cushion and support the different portions of the foot. Some shoes include a harder material on the inner or medial side of a shoe to form a medial post that helps reduce the rolling of a person's foot to the medial side.

Therefore, it is desirable to provide footwear that uniformly supports and aligns a person's feet during walking, jogging and running to help reduce the stresses on a person's feet and body.

SUMMARY

The present article of footwear includes a sole having a midsole and an outsole where the midsole and outsole combine to form a shell having a sidewall that extends above a footbed in the upper to cradle and align a wearer's foot in the article of footwear during use. The sole also provides stability and alignment to the foot by providing enhanced support on the medial and lateral sides of the foot.

In an embodiment, an article of footwear is provided and includes an upper including a footbed, a midsole attached to the upper and including a heel portion, a lateral side and a medial side. An outsole is attached to the midsole to form a sole or shell having a sidewall that extends along the medial side around the heel portion and along at least part of the lateral side, where the sidewall extends along the upper to a point above a top surface of the footbed. The extension of the sidewall above the footbed provides medial and lateral stability to a wearer's foot and also aligns the foot in the article of footwear.

In another embodiment, a sole for an article of footwear is provided and includes a midsole attached to an upper having a lateral side and a medial side. An outsole is attached to the midsole and forms an integral shell having a sidewall that extends along a periphery of the upper from the medial side to at least part of the lateral side of the upper. The shell has a longitudinal axis, where the sidewall is asymmetrical relative to the longitudinal axis.

In a further embodiment, an article of footwear is provided and includes an upper including a footbed and a sole attached to the upper, where the sole includes a midsole and an outsole. The midsole includes a heel portion, a lateral side and a medial side, and a first member and a second member attached to the first member. The first member of the midsole has a sidewall that extends about a periphery of the midsole. The second member of the midsole has a sidewall that extends along the medial side around the heel portion and along the lateral side of the first member. A first portion of the outsole is attached to the first member and a second portion of the outsole is attached to the second member.

In another embodiment, a sole for an article of footwear is provided where the article of footwear includes an upper attached to the sole. The sole includes a midsole attached to the upper, where the midsole includes a lateral side and a medial side. The midsole also includes a first member and a second member, where second member includes a sidewall that extends along a periphery of the midsole from the medial side to at least part of the lateral side. In this embodiment, the midsole has a longitudinal axis, where the sidewall of said second member is asymmetrical relative to the longitudinal axis. The sole also includes an outsole attached the midsole.

In a further embodiment, an article of footwear is provided and includes a sole having a lateral side and a medial side, where the sole includes a first member and a second member attached to the first member, and the first member is separate from the second member. The first member has a sidewall that extends about a periphery of the sole and the second member has a sidewall that extends along the medial side around the heel portion and along the lateral side of the first member.

In another embodiment, a sole for an article of footwear is provided and has an upper, where the sole includes a midsole attached to the upper and including a lateral side and a medial side, and the midsole includes a first member and a second member attached to the first member. The first member is separate from the second member, where the first member has a sidewall that extends about a periphery of the midsole and the second member has a sidewall that extends along the medial side around the heel portion and along the lateral side of the first member.

DETAILED DESCRIPTION

The present sole is attached to an upper to form an article of footwear that stabilizes and cushions a wearer's foot during walking, jogging and running. More specifically, the present sole includes a midsole and an outsole where the outsole is made of a material having a greater hardness than the hardness of the midsole and extends from the lateral side, around the heel to the medial side of the foot on the article of footwear to provide stability and cushioning for the foot and support of the medial side of the foot.

Figure 4:
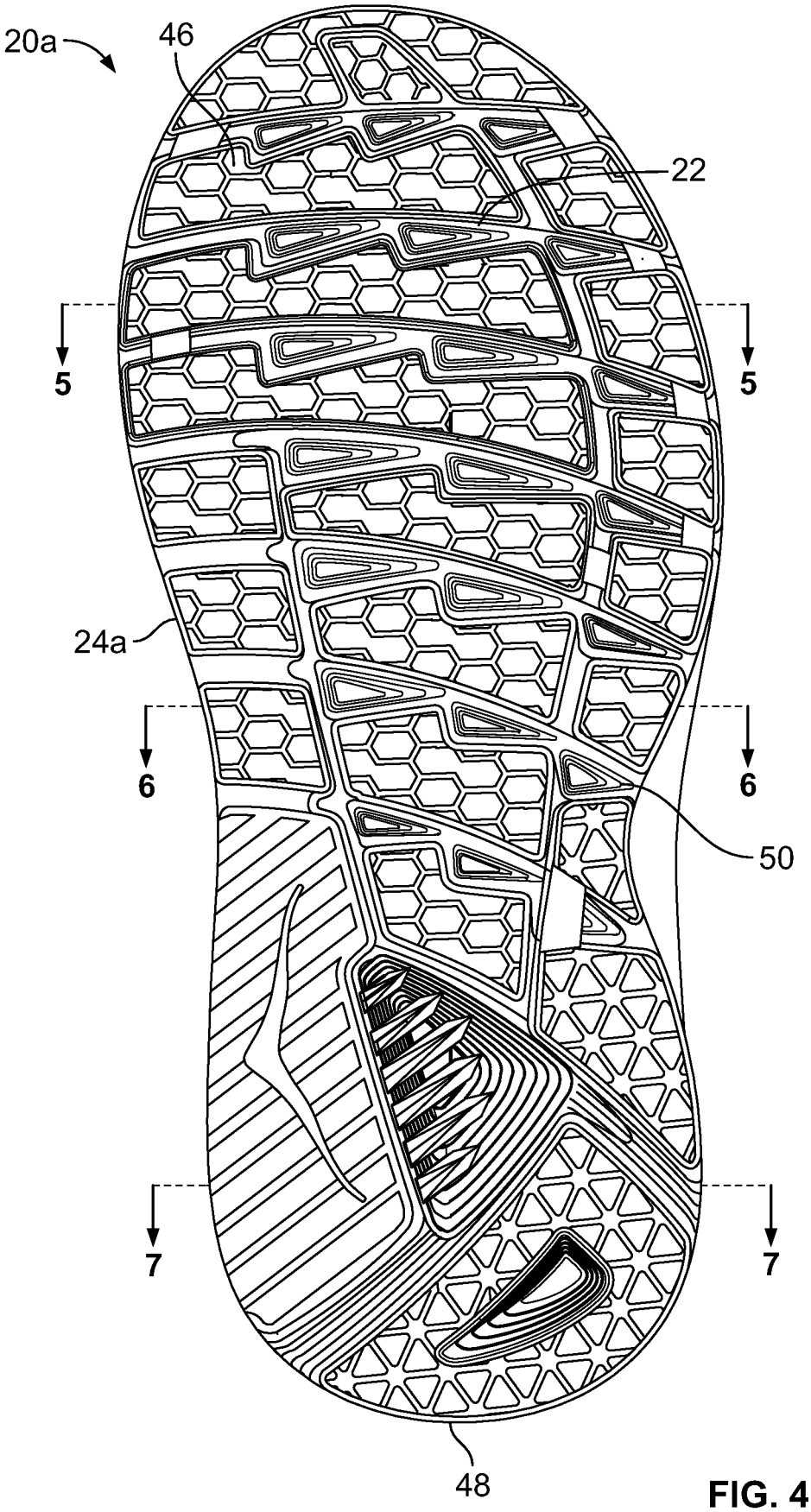
FIG. 4 is a bottom view of the article of footwear of FIG. 2.
Figure 5:
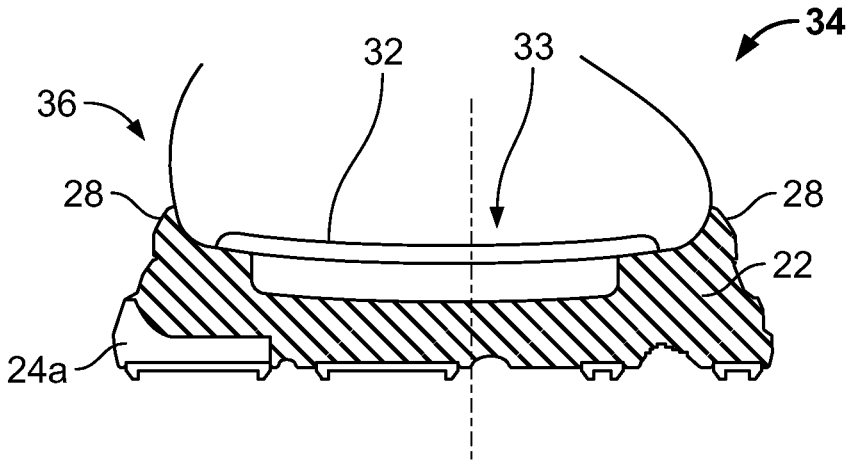
FIG. 5 is a fragmentary, cross-section view of the article of footwear of FIG. 2 taken substantially along the line 5-5 shown in FIG. 4 in the direction generally indicated.
Figure 6:
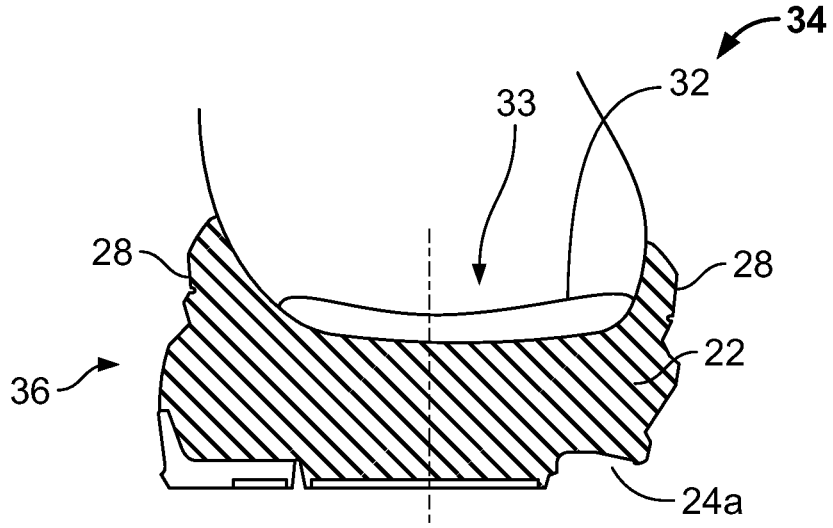
FIG. 6 is a fragmentary, cross-section view of the article of footwear of FIG. 2 taken substantially along the line 6-6 shown in FIG. 4 in the direction generally indicated.
Figure 7:
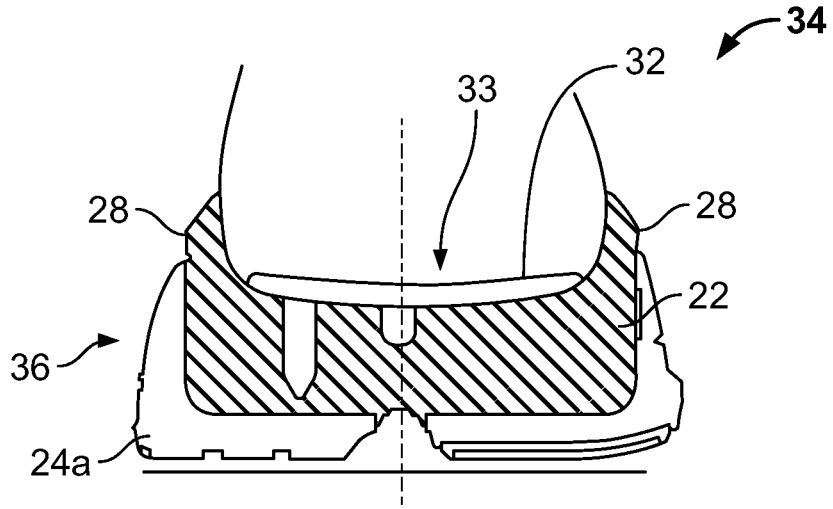
FIG. 7 is a fragmentary, cross-section view of the article of footwear of FIG. 2 taken substantially along the line 7-7 shown in FIG. 4 in the direction generally indicated.
Figure 8:
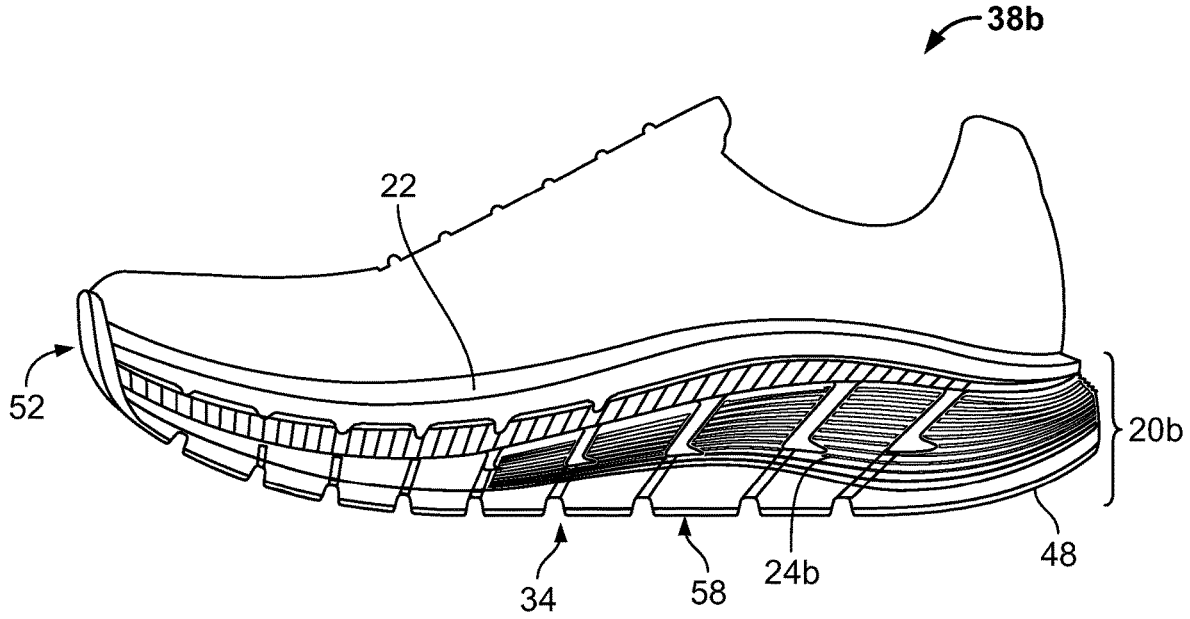
FIG. 8 is an elevational view of the medial side of an article of footwear including another embodiment of the present sole.
Figure 9:
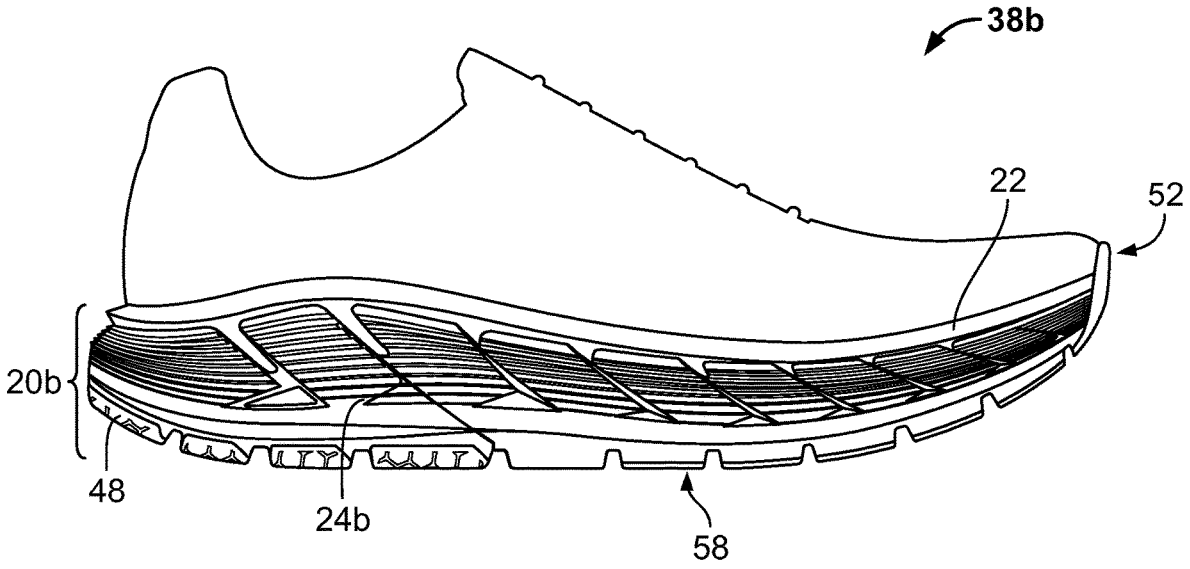
FIG. 9 is an elevational view of the lateral side of the article of footwear of FIG. 8.
Figure 10:
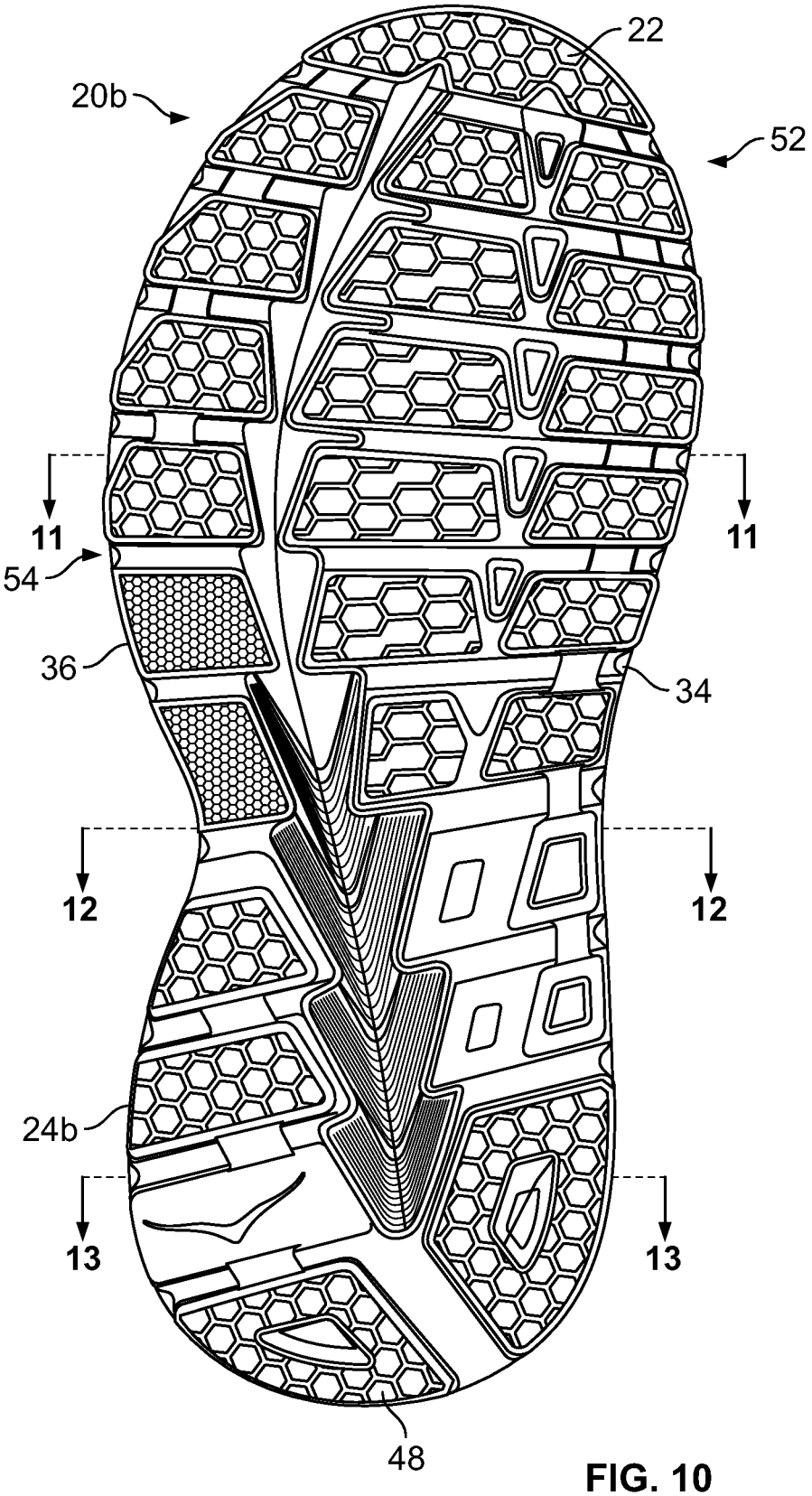
FIG. 10 is a bottom view of the article of footwear of FIG. 8.

Referring now to FIGS. 1-7, an embodiment of the present sole, generally indicated as 20*a*, includes a midsole 22 and an outsole 24*a*. The midsole 22 forms an integral shell including a bottom surface 26, a sidewall 28 that extends about the entire periphery of the midsole, and a top surface 30. As shown in FIG. 5-7, the sidewall 28 extends away from the top surface 32 of the footbed 33 on the medial side 34 and the lateral side 36 of the article of footwear 38*a* such that the sidewall 28 is above the top surface 32 of the footbed on at least the medial and lateral sides of the article of footwear 38 when the article of footwear 38*a* is positioned on an underlying surface. In another embodiment, the sidewall 28 extends above the top surface 32 of the footbed 33 about the entire periphery of the sole 20*a*. In the illustrated embodiment, the sidewall 28 extends seventy percent (70%) of the height of the combined sidewall or total sidewall 40 of the article of footwear where the height is measured from the ground or underlying surface to topmost surface 42 of the total sidewall. The midsole 22 therefore provides rigid support on both the medial and lateral sides of a foot to cradle the foot and limit the movement of the foot toward the medial and lateral sides of the article of footwear 38. Such support also helps to keep the foot aligned in the article of footwear 38*a* to reduce shock and stress on the foot and help channel the motion of the foot primarily to forward and backward motions to improve energy efficiency.

Figure 1:
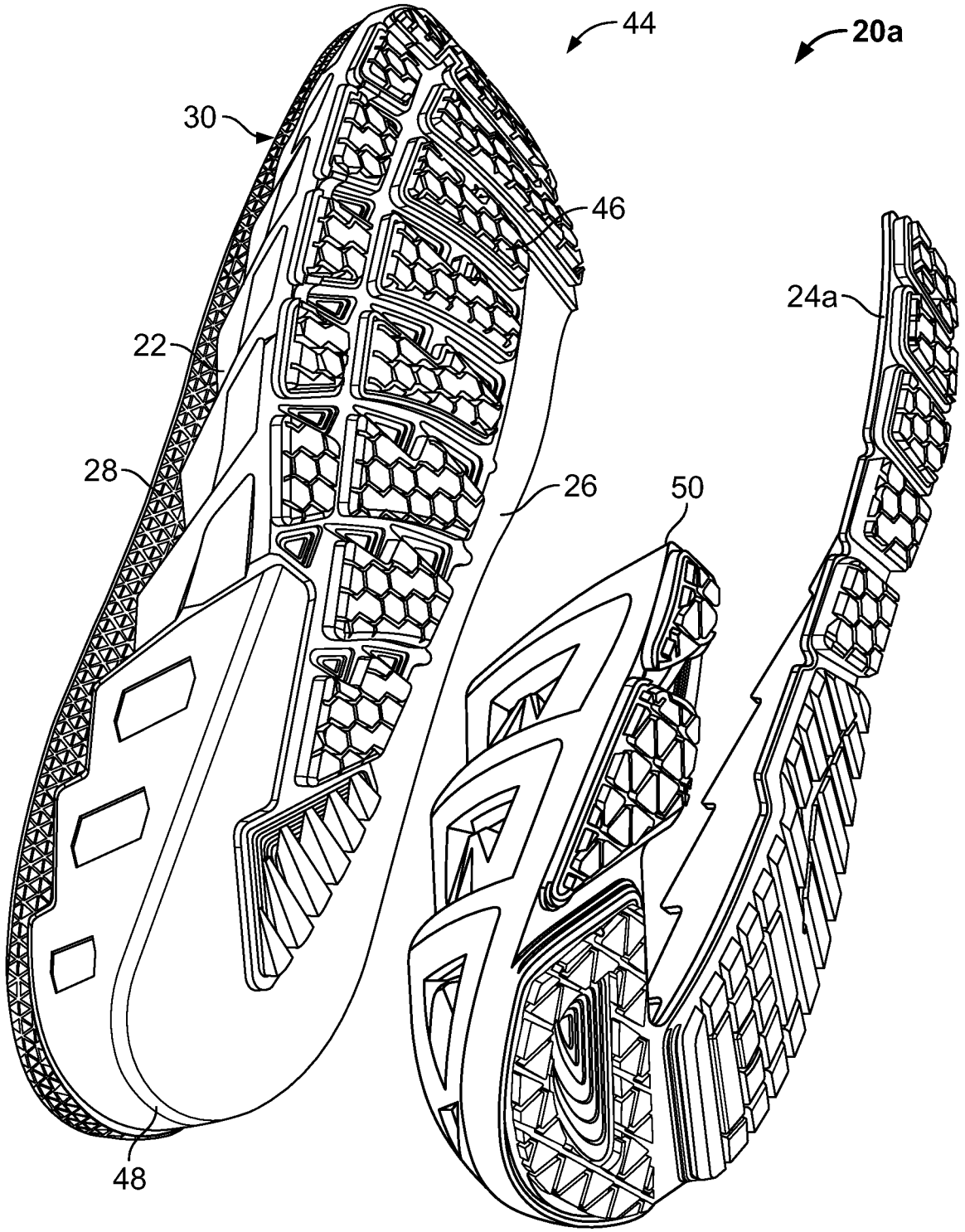
FIG. 1 is an exploded perspective view of the present sole.
Figure 2:
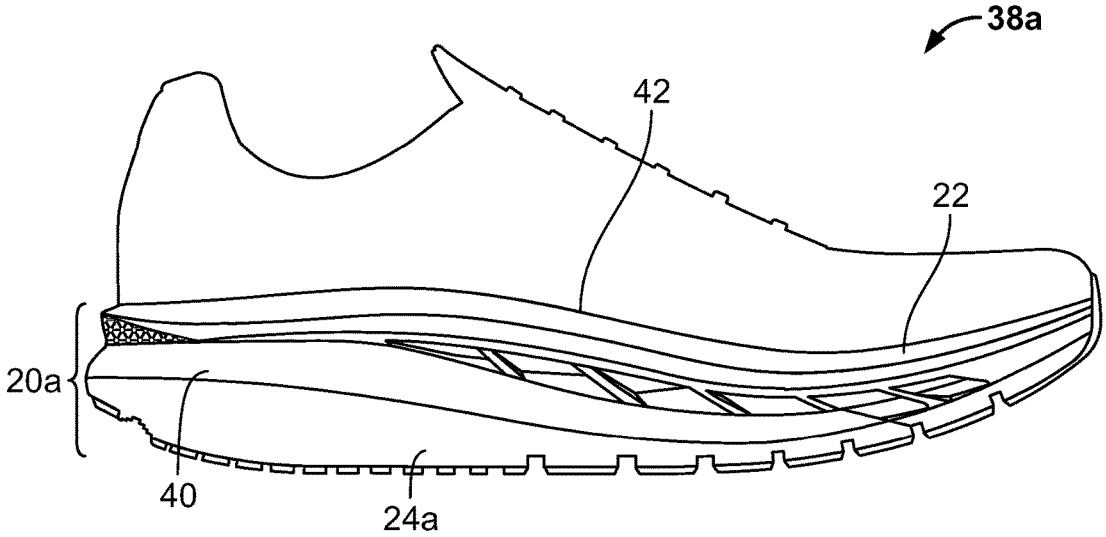
FIG. 2 is an elevational view of the medial side of an article of footwear including the sole of FIG. 1.
Figure 3:
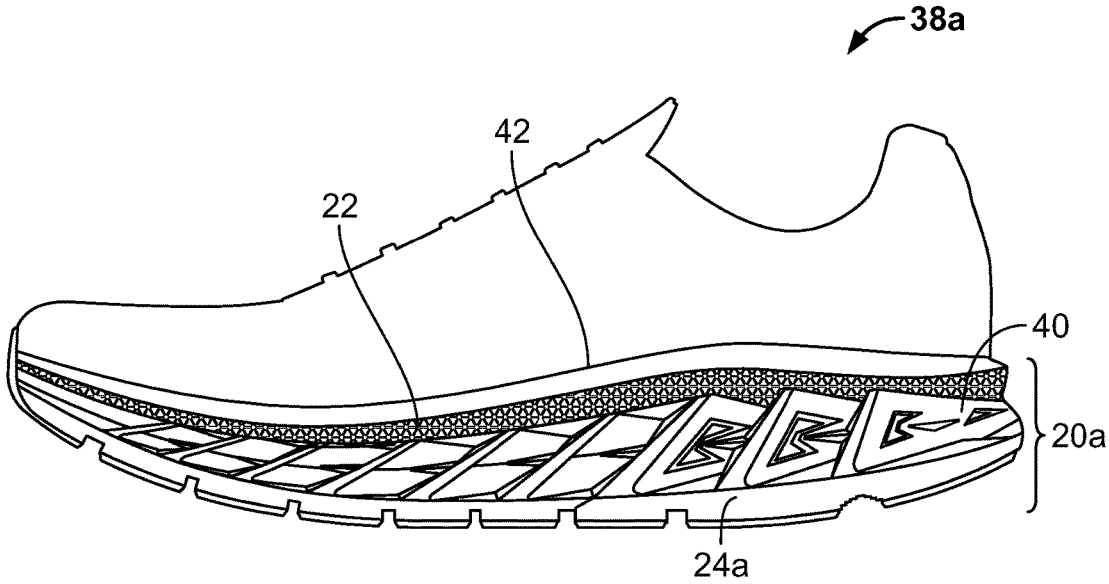
FIG. 3 is an elevational view of the lateral side of the article of footwear of FIG. 1.

As shown FIG. 1 of the illustrated embodiment, a ground-contacting portion 44 of the midsole 22 contacts the ground and thereby includes tread 46 to help grip the ground or other underlying surface during use. The tread 46 may have the same hardness and density as the midsole 22 or have a different hardness and density depending on the terrain that the article of footwear 38*a* will be used on. In an embodiment, the tread 46 is made of rubber. It should be appreciated that the tread 46 may be arranged in any suitable pattern and be made of any suitable material or combination of materials.

The outsole 24*a* is attached to the midsole 22 and is made of a material that has a density and hardness that is greater than the density and hardness of the midsole. For example, in the illustrated embodiment, the outsole 24*a* has a hardness of 55 Asker and the midsole 22 has a hardness of 45 Asker. As such, the outsole 24*a* provides stability to the sole 20*a*, and the midsole 22 provides cushioning and additional stability for a wearer's foot. The hardness of the midsole 22 and the outsole 24*a* may be any suitable hardness values where the difference in the hardness for the midsole and outsole is at least 10 Asker. Also, the outsole 24*a* is preferably made of Ethylene Vinyl Acetate (EVA). Alternatively, the outsole 24*a* may be made of a mixture or blend of EVA and rubber, but may also be made of any suitable material or combination of materials. The midsole 22 is also made of EVA but may be made with foam compounds having designated densities, rebound characteristics and material compositions or other suitable materials or combinations of materials.

As shown in FIGS. 1 and 4, the outsole 24*a* extends from the lateral side 36 around the heel 48 to a position 50 adjacent to the metatarsal bone, and more specifically, the metatarsal head in a wearer's foot on the medial side 34 of the sole 20*a*. In this way, the outsole 24*a* provides a rigid, stable cup or cradle for the heel of the foot during use and also provides sufficient support to the medial side of the foot to help inhibit rolling of the foot such as over pronation. Furthermore, the proportion of the denser, harder outsole material to the softer midsole material provides enhanced cushioning and stability to the foot.

Figure 11:
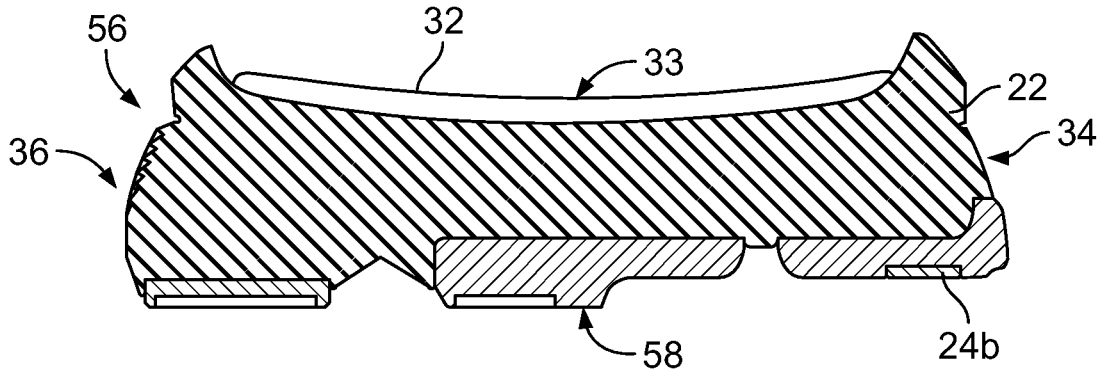
FIG. 11 is a fragmentary, cross-section view of the article of footwear of FIG. 8 taken substantially along the line 11-11 shown in FIG. 10 in the direction generally indicated.
Figure 12:
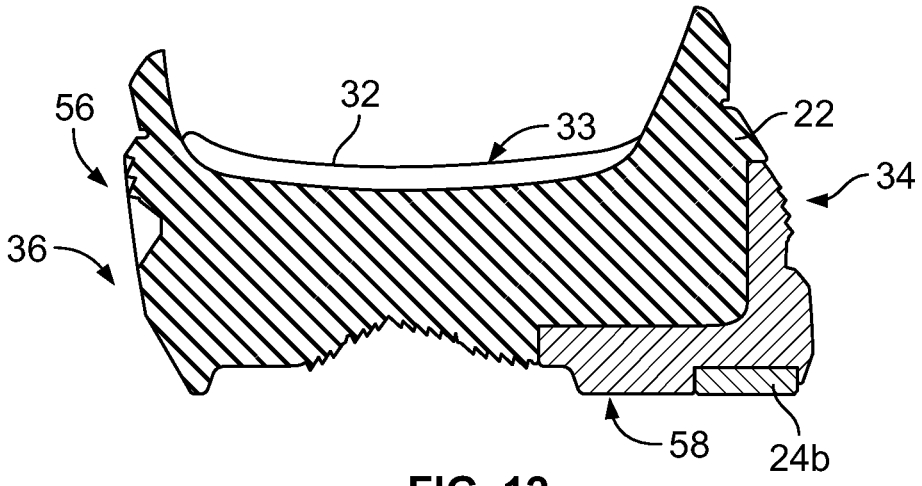
FIG. 12 is a fragmentary, cross-section view of the article of footwear of FIG. 8 taken substantially along the line 12-12 shown in FIG. 10 in the direction generally indicated.
Figure 13:
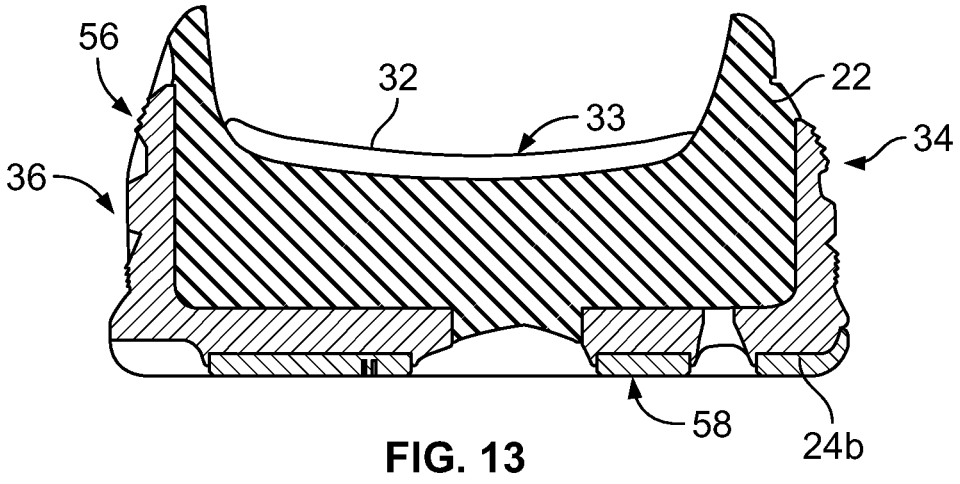
FIG. 13 is a fragmentary, cross-section view of the article of footwear of FIG. 8 taken substantially along the line 13-13 shown in FIG. 10 in the direction generally indicated.

Referring to FIGS. 8-13, in another embodiment, the outsole 24*b* extends from the lateral side of the sole 20*b*, around the heel 48 and along the entire medial side 34 of the sole. In this embodiment, the outsole 24*b* continues around the toe or front portion 52 of the sole 20*b* and to a point or position 54 on the lateral side 36 of the shoe. This sole construction provides added support and stability to a wearer's foot during use. Further, the midsole 22 and outsole 24*b* forming the sole are made of the same materials and have the same hardness and density value as described above. As shown in FIGS. 11-13, the combined sidewall 56 of the midsole 22 and the outsole 24*b* extends above the top surface 32 of the footbed 33 to cradle the foot on both the medial and lateral sides of the article of footwear. This sole configuration helps to limit movement of the foot in the article of footwear as well as provides stability and rigidity for limiting rolling of the foot during use.

In the above embodiments, the medial sidewall of the midsole 22 and outsole 24*a*, 24*b* has a first height relative to the bottom surface 58 of the article of footwear 38*a*, 38*b* and the lateral sidewall of the midsole 22 and outsole 24*a*, 24*b* has a second height relative to the bottom surface of the article of footwear. In an embodiment, the height of the medial sidewall is greater than the height of the lateral sidewall such that the sidewalls of the medial and lateral sidewalls are asymmetrical relative to a longitudinal axis extending through the article of footwear. This construction provides more support to the medial side of the article of footwear to help control inward rolling of the foot during use. In another embodiment, the heights of the medial and lateral sidewalls of the midsole 22 and outsole 24*a*, 24*b* are symmetrical relative to each other, i.e., the heights of the medial and lateral sidewalls are the same. This construction provides equal support to a foot (neutral stability) on the medial and lateral sides 34, 36 of the article of footwear 38*a*, 38*b*. In a further embodiment, the height of the lateral sidewall relative to the bottom surface 58 of the article of footwear 38*a*, 38*b* is greater than the height of the medial sidewall relative to the bottom surface 58 of the article of footwear 38*a*, 38*b*. This construction provides greater support to the lateral side of the foot during use to help control outward rolling of the foot. It should be appreciated that the heights of the medial and lateral sidewalls of the article of footwear may be any suitable heights relative to the bottom surface of the article of footwear 38*a*, 38*b*.

Referring now to FIGS. 14-20, another embodiment of the present sole 100 is shown and includes a midsole 102 and an outsole 104 attached to the midsole. In this embodiment, the midsole 102 includes a first member 106 and a second member 108 that combine to form a midsole shell. More specifically, FIGS. 14-17A show the present sole 100 for a right shoe that is configured to be worn on a right foot of a user, and FIGS. 17B-20 show the present sole 100 for a left shoe that is configured to be worn on a left foot of a user.

Figure 14:
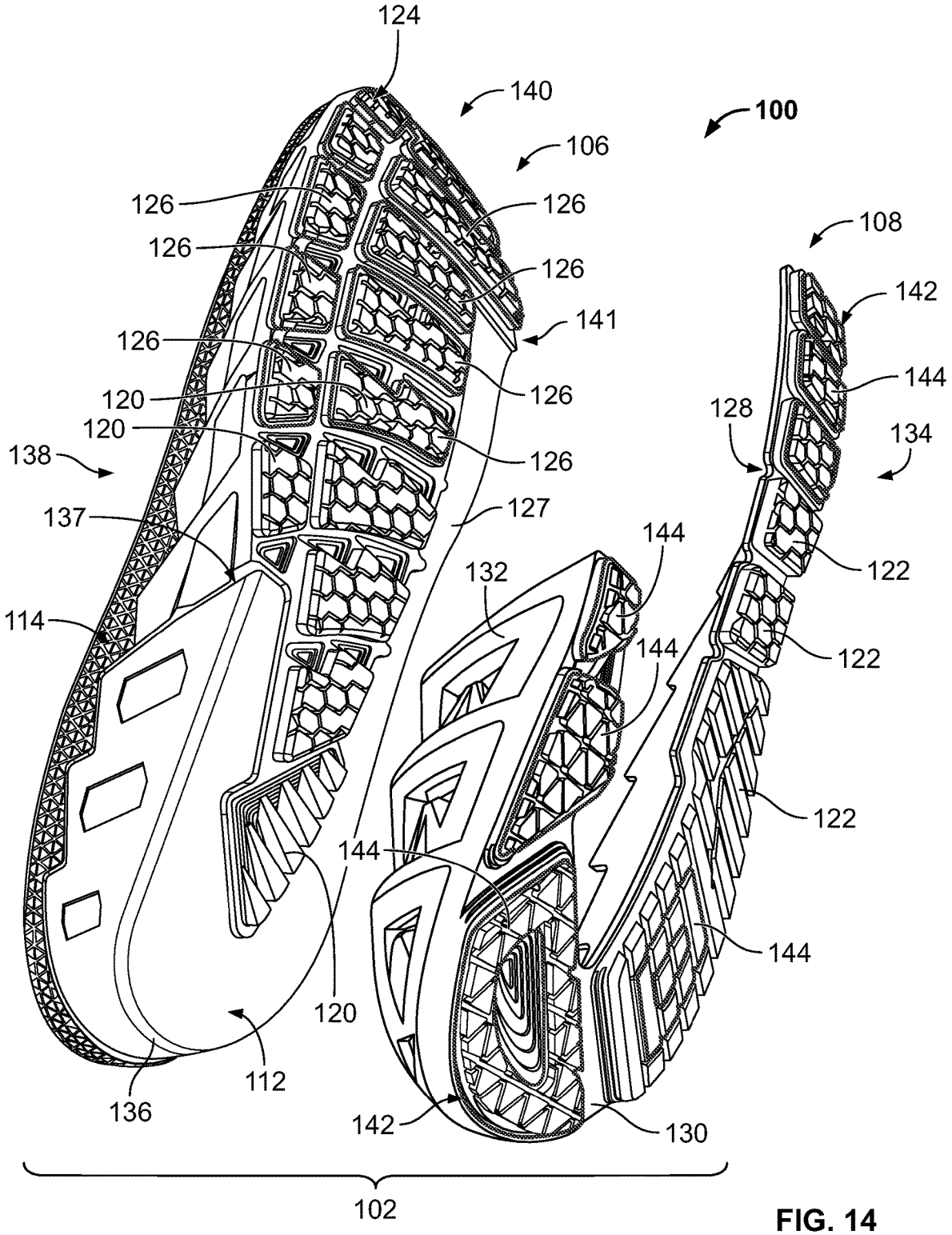
FIG. 14 is an exploded perspective view of another embodiment of the present sole.
Figure 15:
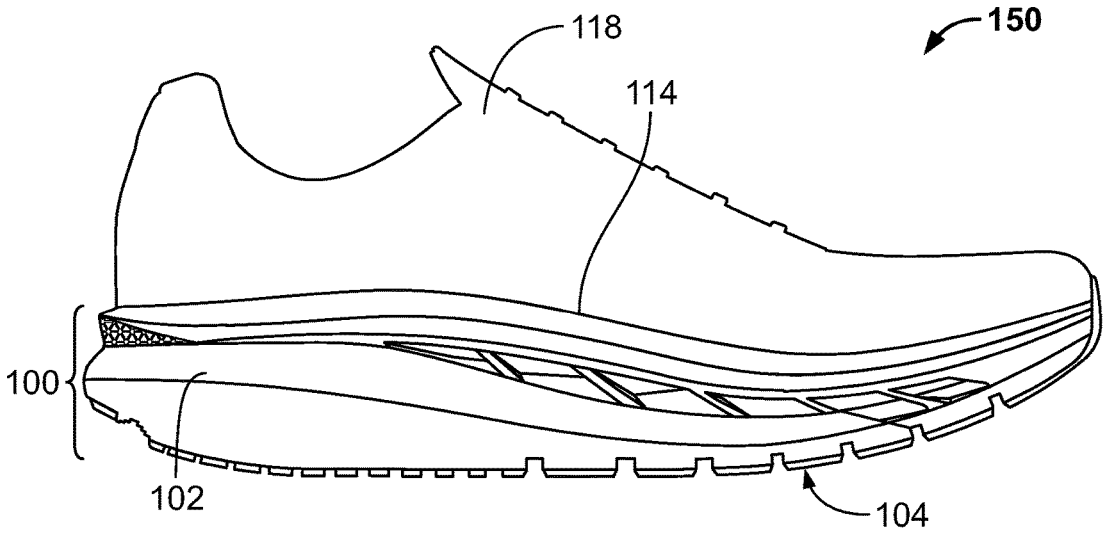
FIG. 15 is an elevational view of the medial side of an article of footwear including the sole of FIG. 14.
Figure 16:
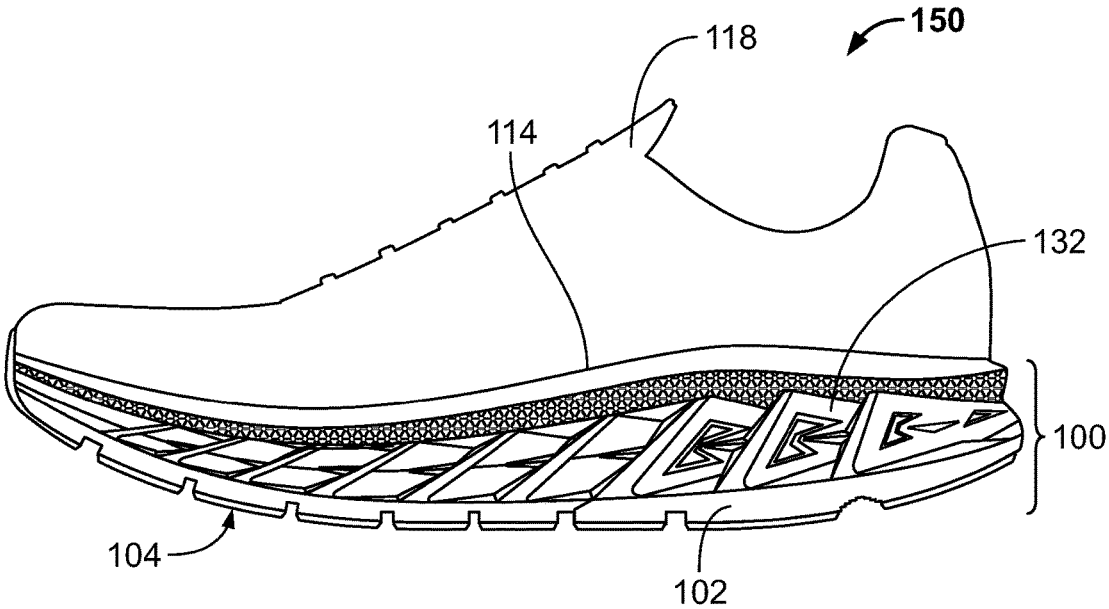
FIG. 16 is an elevational view of the lateral side of the article of footwear including the sole of FIG. 14.

In this embodiment, the first member 106 of the midsole 102 is a cushioning member and includes a top surface 110, a bottom surface and a sidewall 114 extending about an entire periphery of the first member 106. As shown in FIGS. 14-16 and 17A, the sidewall 114 extends above the top surface 110 of the first member to form a recessed area 116 configured to receive the upper 118 (FIGS. 15-16). The first member 106 is preferably made of EVA, such as a molded EVA, but may also be made of rubber or another suitable material or combination of materials. As shown in the illustrated embodiment, the bottom surface 112 of the first member 106 includes at least one midsole tread member 120 and preferably, a plurality of midsole tread members 120 (shown as non-bold outlined tread members), that are each configured to contact an underlying surface during use such as during standing, walking or running. As shown, a first portion 124 of the outsole 104 is attached to the first member 106, where the first portion 124 of the outsole includes at least one outsole tread member 126, and preferably a plurality of outsole tread members 126 (shown with bold outlines), as shown in FIG. 14. Each of the midsole tread members 120 and the outsole tread members 126 have a pre-determined size and shape, and a pre-determined pattern, where the size, shape and pattern are based on the terrain that the footwear will be used on. It is contemplated that the midsole tread members 120 are made of an EVA but may be made with any suitable material or combination of materials. In the illustrated embodiment, the bottom surface 112 of the first member 106 also includes an attachment area 127 that extends from the medial side about the heel portion to the lateral side of the midsole.

The second member 108 of the midsole 102 is a stabilizing member and includes a top surface 128, a bottom surface 130 and a sidewall 132, and is attached to the attachment area 127 on the bottom surface of first member 106, where the size and shape of the attachment area 127 corresponds to the size and shape of the second member. The second member 108 may be attached to the first member 106 using an adhesive or any suitable attachment method. As shown in FIG. 14, the sidewall 132 extends along at least part of a medial side 134, about the heel portion 136 and along at least part of a lateral side 138 of the first member 106. In this embodiment, the sidewall 132 extends to an end point 141 along the medial side 134 that is closer to a front end (toe portion) 140 of the midsole 102 than an end point 137 on the lateral side 138. Furthermore, the sidewall 132 has a predetermined height on the lateral side 138, where the height of the sidewall 132 gradually decreases as the sidewall extends about the heel portion 136 and along the medial side 134 of the first member 106. In another embodiment, the sidewall 132 has the same height on the medial and lateral sides 134, 138. In a further embodiment, the height of the sidewall is greater on the medial side 134 than on the lateral side 138.

As shown in FIG. 14, the second member 108 includes at least one midsole tread member 122, and preferably a plurality of midsole tread members 122 (shown as non-bold outlined tread members), that are attached to the bottom surface 130 of the second member, and configured to contact an underlying surface, such as the ground, during use. It is contemplated that the midsole tread members 122 are made of EVA but may be made with any suitable material or combination of materials. As shown, a second portion 142 of the outsole 104 is attached to the bottom surface 130 of the second member 108 and includes at least one outsole tread member 144, and preferably a plurality of outsole tread members 144 (shown in bold outline), that each have a predetermined size, shape and pattern. It should be appreciated that the midsole and outsole tread members 120, 126 on the first member 106 and the midsole and outsole tread members 122, 144 on the second member 108 may be the same size and shape, and have the same pattern, or one or more of the midsole and outsole tread members may a different size, shape and/or pattern.

As described above, the midsole 102 is formed by the combination of the first member 106 (cushioning member) and the second member 108 (stabilizing member) to provide cushioning and stability to a user's foot during use. Further, the outsole tread members 126 and 144 attached to the bottom surfaces 112, 130 of the first and second members 106, 108 of the midsole 102 are configured to add durability to the sole 100 and thereby protect the softer cushioning material of the first member 106 and the bottom surfaces of the first and second members 106, 108 to help prevent wear. It should be appreciated that the outsole, i.e., the outsole tread members 126, 144, may be attached to a portion of the bottom surfaces 112, 130 of the first and second members 106, 108 of the midsole, or the entirety of the bottom surfaces of the first and second members. In another embodiment, the first and second members 106, 108 include midsole tread members 120, 122, extend along the entirety of the bottom surfaces 112, 130 of the first and second members such that there is no outsole attached to the bottom surfaces of the first and second members.

Figure 17A:
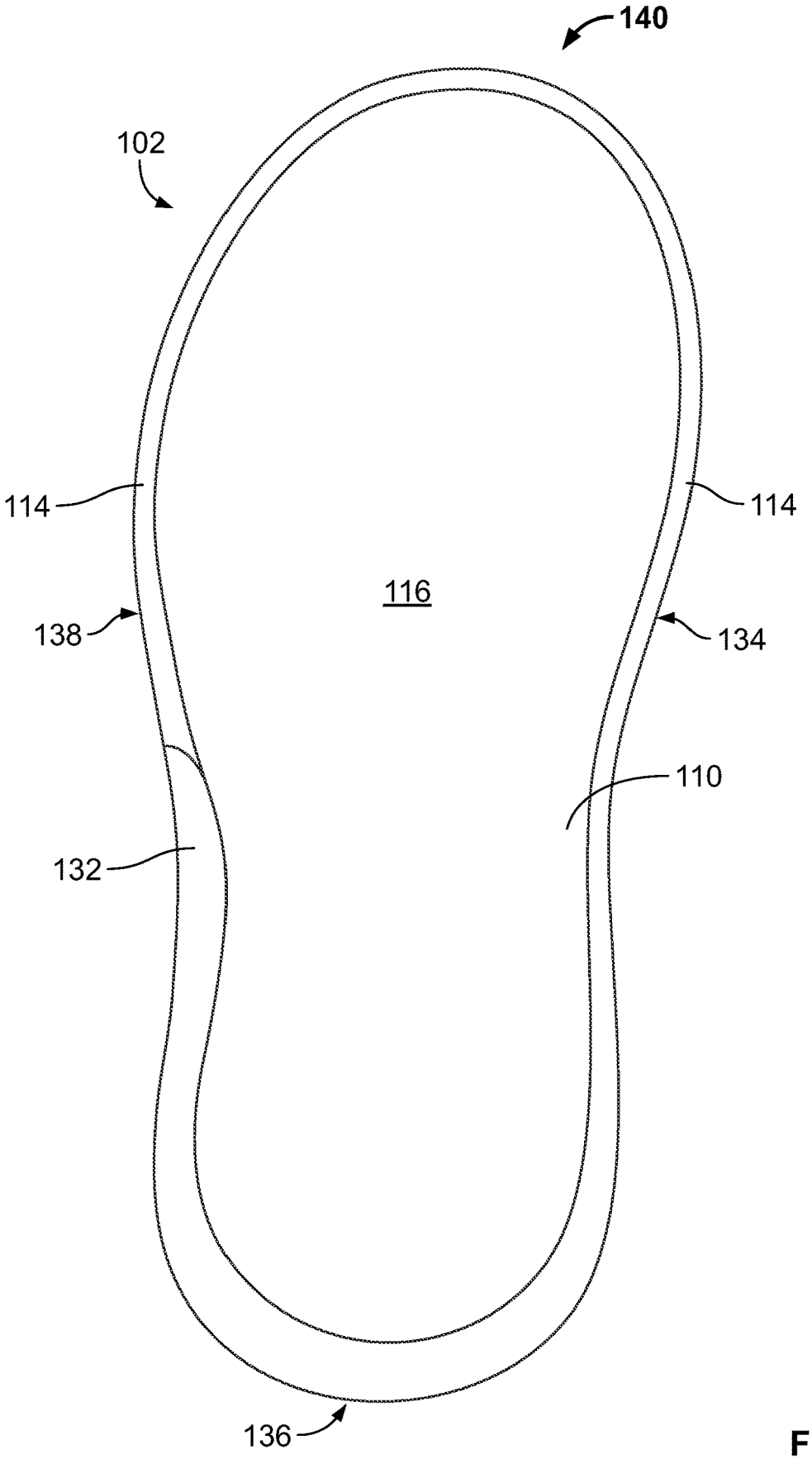
FIG. 17A is a top view of the sole of FIG. 14.
Figure 17B:
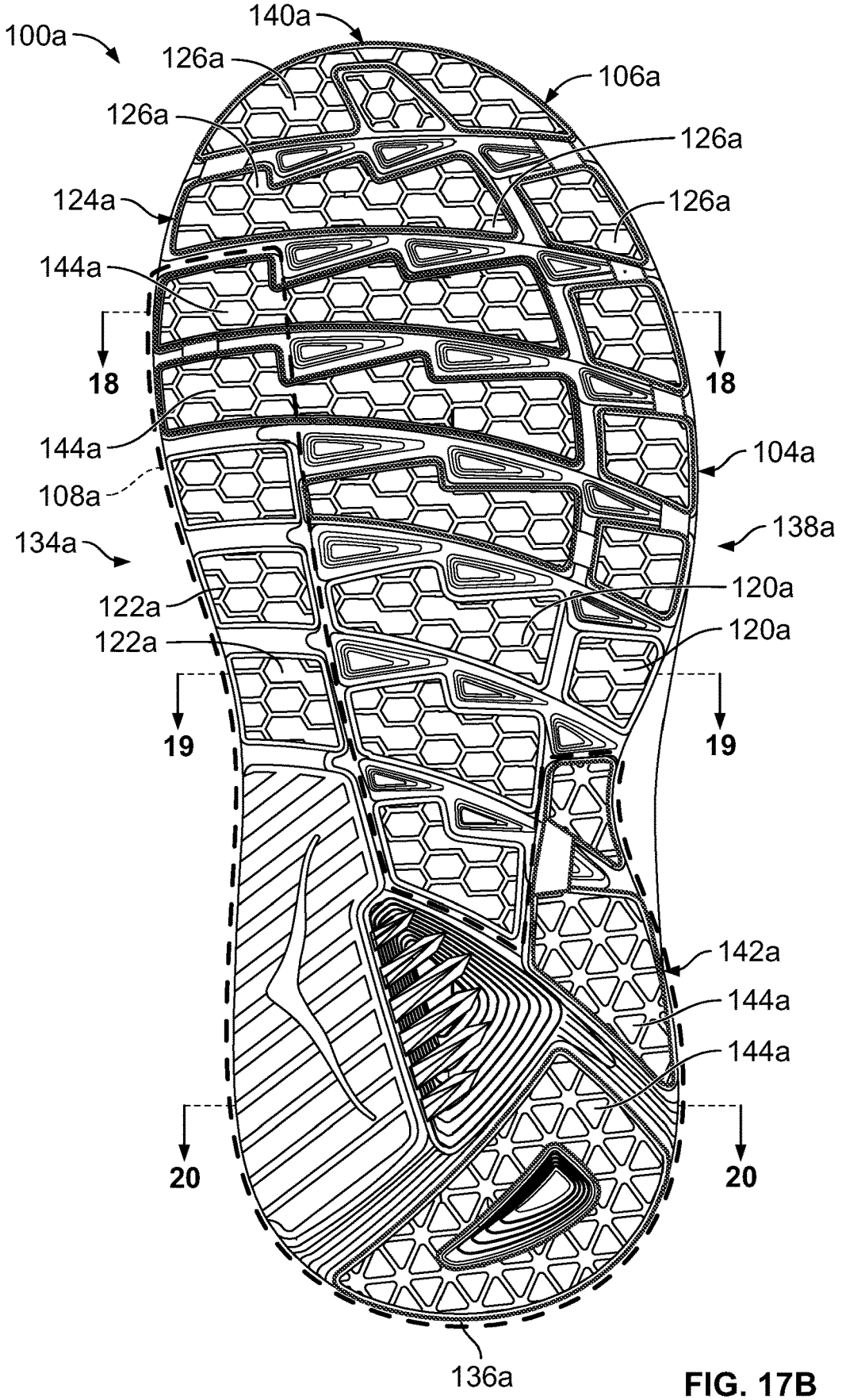
FIG. 17B is a bottom view of a further embodiment of the present sole.
Figure 18:
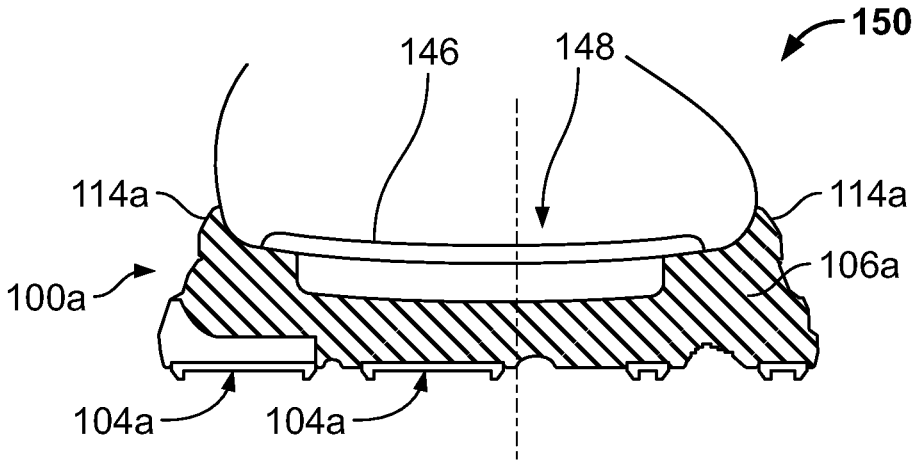
FIG. 18 is a fragmentary, cross-section view of the sole of FIG. 17B taken substantially along the line 18-18 shown in FIG. 17B in the direction generally indicated.
Figure 19:
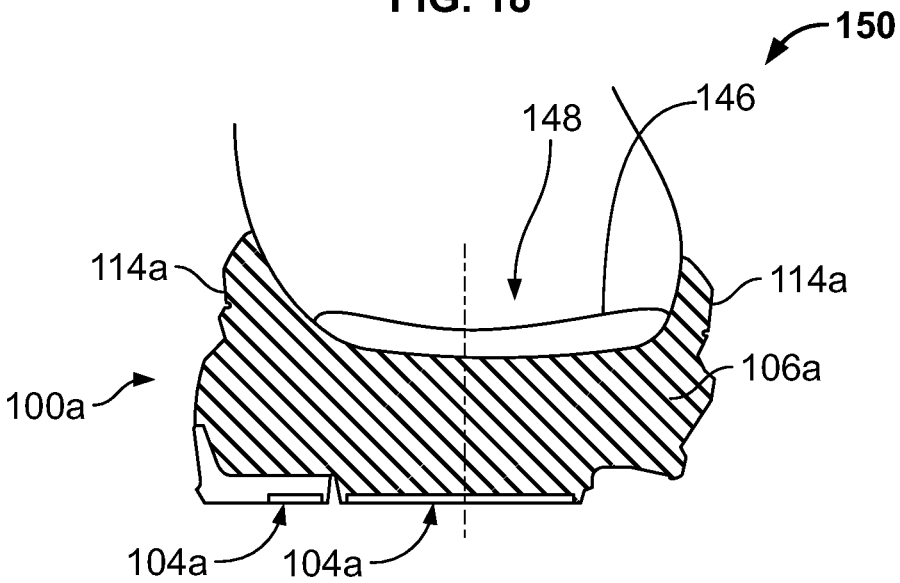
FIG. 19 is a fragmentary, cross-section view of the sole of FIG. 17B taken substantially along the line 19-19 shown in FIG. 17B in the direction generally indicated.
Figure 20:
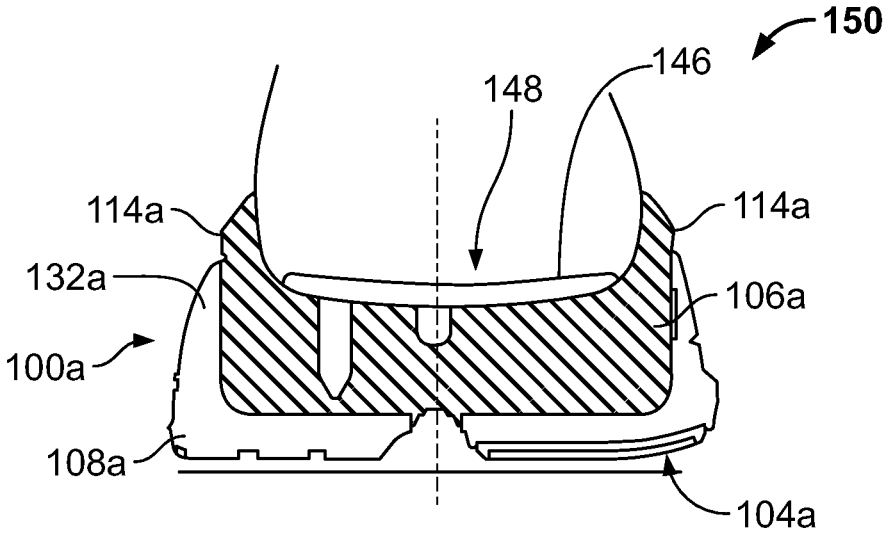
FIG. 20 is a fragmentary, cross-section view of the sole of FIG. 17B taken substantially along the line 20-20 shown in FIG. 17B in the direction generally indicated.

As shown in FIGS. 14 and 17B, the second member 108 extends from the lateral side 138 around the heel portion 136 to a position (end point 141) on the medial side 134 that is adjacent to the metatarsal bone, and more specifically, the metatarsal head in a wearer's foot on the medial side 134. In this way, the midsole 102 provides a rigid, stable cup or cradle for the heel of the foot during use and also provides sufficient support to the medial side 134 of the foot to help inhibit rolling of the foot such as over pronation.

In this embodiment, the sidewall 114 of the first member 106 and at least a portion of the sidewall 132 of the second member 108, extend away from a top surface 146 of footbed 148 such that the sidewall 114 is above the top surface 146 of the footbed 148 on at least the medial side 134 and the lateral side 138 of the article of footwear 150 when the article of footwear 150 is positioned on an underlying surface. In another embodiment, the sidewall 114 extends above the top surface 146 of the footbed 148 about the entire periphery of the midsole 102. The configuration of the midsole 102, and more specifically, the midsole shell in this embodiment, provides rigid support on both the medial and lateral sides of a foot to cradle the foot and limit the movement of the foot toward the medial and lateral sides of the article of footwear 150. As stated above, this support helps to keep the foot aligned in the article of footwear 150 to reduce shock and stress on the foot and help channel the motion of the foot primarily to forward and backward motions to improve energy efficiency.

As stated above, FIGS. 17B to 20 show the present sole on a left shoe where the shoe includes a lateral side 138*a*, a medial side 134*a*, a front portion 140*a* and a heel portion 136*a*. In this embodiment, the sole 100*a* includes a midsole 102*a* and an outsole 104*a*. The outsole 104*a*, which is formed by the first and second portions 124*a*, 142*a* respectively on the first member 106*a* (with sidewall 114*a*), and second member 108*a* (with sidewall 132*a*) of the midsole 102*a*, is attached to the midsole and is made of a material that has a density and/or hardness that is greater than the density and/or hardness of the midsole. In this embodiment, the first portion 124*a* of the outsole includes midsole tread members 120*a* and outsole tread members 126*a*. Also, the second portion 142*a* of the outsole includes midsole tread members 122*a* and outsole tread members 144*a*.

Additionally, in the illustrated embodiments, the second member 108*a* (stabilizing member) shown by the area outlined by dashed lines, has a hardness value that is greater than a hardness value of the first member 106*a* (cushioning member). For example, in an embodiment, the hardness value of the second member is 55 Asker and the hardness value of the first member is 45 Asker. As such, the second member 108*a* provides stability to the sole 100*a*, and the first member 106*a* provides cushioning and comfort for a wearer's left foot (or right foot as shown in FIG. 14). It should be appreciated that the hardness (hardness values) of the first member 106*a* and the second member 108*a* may be any suitable hardness values. In an example embodiment, the difference in the hardness values for the first member 106*a* and the second member 108*a* is at least 10 Asker.

Also, in the illustrated embodiments, the outsole 104*a* is preferably made of EVA. In another embodiment, the outsole 104*a* may be made of rubber or a mixture or blend of EVA and rubber, or may also be made of any suitable material or combination of materials. As stated above, the midsole 102*a*, and more specifically, the first and second members 106*a*, 108*a* of the midsole, are made of EVA but may be made with foam compounds having designated densities, rebound characteristics and material compositions or other suitable materials or combinations of materials. Furthermore, the proportion of the denser, harder outsole material to the softer midsole material provides enhanced cushioning and stability to the foot during use.

While particular embodiments of the present sole for an article of footwear have been shown and described, it will be appreciated by those skilled in the art that changes and modifications may be made thereto without departing from the invention in its broader aspects and as set forth in the following claims.

What is claimed is:

1. A sole for an article of footwear having an upper, the sole comprising:

a midsole attached to the upper and including a lateral side and a medial side, said midsole including a first member and a second member attached to said first member, said first member being separate from said second member;

said first member having a sidewall and a recessed area; and said second member having a sidewall that extends along the medial side around the heel portion and along the lateral side of said first member, said second member being positioned in said recessed area of said first member.

2. The sole of claim 1, wherein said midsole includes a longitudinal axis and said sidewall of said second member is asymmetrical relative to said longitudinal axis.

3. The sole of claim 1, wherein a height of the sidewall of said second member on said lateral side is greater than a height of the sidewall of said second member on said medial side.

4. The sole of claim 1, wherein a height of the sidewall of said second member on said medial side is greater than a height of the sidewall of said second member on said lateral side.

5. The sole of claim 1, wherein a hardness of said first member and a hardness of said second member are different.

6. The sole of claim 1, wherein a hardness of said first member and a hardness of said second member are the same.

7. The sole of claim 1, further comprising an outsole, wherein a first portion of said outsole is attached to said first member and a second portion of said outsole is attached to said second member.

8. The sole of claim 1, wherein the difference of the hardness of said second member and the hardness of said first member is at least 10 Asker.

9. The sole of claim 1, wherein the difference of the hardness of said first member is 45 Asker and the hardness of said second member is 55 Asker.

* * * * *